US006772966B2

(12) United States Patent
Foster et al.

(10) Patent No.: US 6,772,966 B2
(45) Date of Patent: Aug. 10, 2004

(54) ADJUSTABLE HOSE END SPRAYER NOZZLE

(75) Inventors: Donald D. Foster, St. Charles, MO (US); Philip L. Nelson, Wildwood, MO (US); Jeffrey P. Stark, O Fallon, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 300 days.

(21) Appl. No.: 10/119,451

(22) Filed: Apr. 10, 2002

(65) Prior Publication Data

US 2003/0192964 A1 Oct. 16, 2003

(51) Int. Cl.[7] ..... B05B 1/30; B05B 7/30

(52) U.S. Cl. ..... 239/581.2; 239/310; 239/318; 239/378; 239/581.1; 239/569

(58) Field of Search ..... 239/310, 315, 239/316, 318, 375, 378, 451, 456, 457, 458, 537, 538, 539, 569, 581.1, 581.2

(56) References Cited

U.S. PATENT DOCUMENTS 4,369,921 A * 1/1983 Beiswenger et al. ..... 239/317
5,320,288 A 6/1994 Ketcham, Jr.
5,383,603 A 1/1995 Englhard et al.
5,954,272 A * 9/1999 Liao ..... 239/317
6,378,785 B1 * 4/2002 Dodd ..... 239/318
6,425,534 B2 * 7/2002 Ketcham et al. ..... 239/316
6,471,141 B2 * 10/2002 Smith et al. ..... 239/10
6,578,776 B1 * 6/2003 Shanklin et al. ..... 239/318

* cited by examiner

*Primary Examiner*—Robin O. Evans
(74) *Attorney, Agent, or Firm*—Thompson Coburn LLP

(57) ABSTRACT

An adjustable nozzle is attachable to the end of a garden hose and is also attachable to a separate product container, for example, a bottle containing a garden fertilizer or a bottle containing a cleaning soap concentrate. The adjustable nozzle receives a flow of water from the garden hose and dispenses a product from the container attached to the nozzle. The nozzle has a simplified construction with a reduced number of component parts and the operation of the nozzle is simplified yet enables a user to selectively discharge a flow of water or a mixture of water and product from the nozzle, to control the ratio of water to product when the nozzle is employed in dispensing the mixture of water and product, and to direct the discharge as a stream or disperse the discharge in an upwardly or downwardly directed fanned spray pattern.

33 Claims, 9 Drawing Sheets

ADJUSTABLE HOSE END SPRAYER NOZZLE

BACKGROUND OF THE INVENTION (1) Field of Invention

The present invention pertains to an adjustable nozzle that is attached to the end of a garden hose and is also attached to a separate product container, for example, a bottle containing a garden fertilizer or a bottle containing a cleaning soap concentrate. More specifically, the present invention pertains to an adjustable nozzle that receives a flow of water from a garden hose and dispenses a product from a container attached to the nozzle, where the nozzle has a simplified construction with a reduced number of component parts and where the operation of the nozzle is simplified yet enables a user to selectively discharge a flow of water or a mixture of water and product from the nozzle, control the ratio of water to product when the nozzle is employed in dispensing the mixture of water and product, and to direct the discharge as a stream or disburse the discharge in an upwardly or downwardly directed fanned spray pattern.

(2) Description of the Related Art

A typical hose end sprayer has two connections, one of which is connected to the end of a garden hose that serves as a supply of water under pressure to the sprayer and the second of which is connected to a separate product container to be selectively dispensed from the sprayer. Sprayers of this type are often used in the home garden or yard for dispensing chemicals such as weed killer or fertilizer mixed with the flow of water passing through the sprayer. In addition, sprayers of this type are used with a soap product contained in the separate container where the flow of water mixes with the soap product as it passes through the sprayer. Sprays of this type are often used to wash automobiles, housing siding and windows of a home. In the typical operation of these sprayers, the flow of water through the sprayer interior creates a venturi effect in the sprayer that draws the product contained in the product container into the flow of water where it is mixed with the water before being discharged from the sprayer.

Because the sprayers of the type described above are sold as household products that are used to spread chemicals in the home garden or yard or to wash the siding, windows or automobile of the homeowner, it is very desirable that the sprayers be constructed inexpensively and be easy to operate. In addition, it is also desirable that the sprayers provide features that enhance their usefulness without detracting from the ease of operating the sprayers. In many prior art hose end sprayers that have several useful features, for example, a control valve that has the options of stopping the flow of water through the sprayer nozzle, or opening the flow of water through the sprayer nozzle without mixing with the contents of the separate product container, or opening the flow of water through the sprayer nozzle while mixing with the contents of the separate product container, the control valve that is simple to operate requires additional component parts for the sprayer nozzle, or the control valve that has a reduced number of component parts is difficult to operate. Increasing the component parts of the sprayer nozzle increases its cost, making it unattractive to consumers. In addition, sprayer nozzles that are difficult to operate, although reduced in cost, are still not attractive to consumers.

What is needed to overcome the disadvantages of prior art hose end sprayer nozzles is a simplified construction of a nozzle with a reduced number of component parts that is also simple to operate and provides a number of desirable features. Such a sprayer nozzle would be attractive to consumers for both having a reduced cost due to its reduced number of component parts as well as its ease of operation.

SUMMARY OF THE INVENTION

The hose end sprayer nozzle of the present invention overcomes the several disadvantages associated with prior art sprayer nozzles by providing a nozzle with simplified construction and a reduced number of component parts that is easy to operate and yet provides many options that are desirable to consumers.

The sprayer nozzle of the invention is assembled from a total of twelve component parts. In the preferred embodiment, the component parts are molded of various types of plastics. The component parts of the sprayer nozzle include a two-piece housing, a three-piece control valve assembly contained in the housing, a two-piece manual actuator mounted on the housing, a two-piece hose connector mounted on the housing, a dip tube, a product port control valve and a spray deflector.

The two-piece housing includes a housing front piece that is snap-fit to a housing back piece. Together, the two pieces define a housing having an interior bore that passes between an inlet end of the housing and an outlet end of the housing. The interior bore defines a fluid flow path through the housing between the inlet and outlet ends.

An internally screw threaded hose connector containing a sealing washer or gasket is mounted to the housing inlet end for rotation of the connector relative to the housing. The interior threading of the hose connector mates with the typical exterior threading of a home garden hose. The housing also has a second connector that is connectable to a separate product container. In the preferred embodiment, the second connector is a bayonet type connector that can be releasably attached to a separate bottle of product having a complementary bayonet connector. A product port in the separate container connector and the dip tube extending from the product port communicate the separate container with the fluid flow path in the housing interior bore.

The control valve assembly is mounted in the fluid flow path in the housing interior bore. The control valve assembly includes a control valve that has an interior bore that functions as a portion of the fluid flow path through the nozzle. The control valve is mounted in the housing for reciprocating movement of the control valve along the flow path. A back flow check valve is mounted in the interior bore of the control valve and is operable to permit liquid flow along the flow path from the inlet end of the nozzle housing to the outlet end, but to prevent reverse flow through the flow path from the housing outlet end to the housing inlet end.

The two-piece manual actuator is mounted on the exterior of the nozzle housing and is operatively connected with the control valve. The manual actuator causes the control valve to reciprocate forwardly and rearwardly along the flow path in the housing interior bore in response to manual rotation of the actuator in opposite directions about the housing exterior. Manual rotation of the actuator in opposite directions moves the control valve through the housing interior bore between three positions of the control valve relative to the housing and the flow path. In the first position of the control valve relative to the housing interior, the control valve blocks the flow of liquid through the housing flow path. In the second position of the control valve relative to the housing it opens or unblocks the flow path through the housing but blocks the product port of the housing that communicates with the separate container of product connected to the housing. In the third position of the control valve relative to the housing, the valve unblocks both the fluid flow path through the housing and the product port, communicating the product container attached to the housing with the fluid flow path. This third position of the control valve and the flow of liquid through the housing interior creates a venturi in the flow path that draws product from the connected product container into the flow of liquid through the housing.

The product port valve is mounted to the housing for movement of the valve between first and second positions. The valve includes a center bore that forms a portion of the fluid flow path through the housing. The product port valve also has a pair of valve openings with a first of the valve openings having a smaller opening area than the second of the valve openings. In the first position of the product port valve, the first, smaller valve opening is aligned with the product port. In the second position of the product port valve, the second, larger valve opening is aligned with the product port. By selectively choosing which valve opening of the product port valve is aligned with the product port, the concentration of the product contained in the separate container that is mixed with the flow of water channeled through the housing interior bore can be changed.

A discharge deflector is mounted to the valve housing at the housing outlet end. The deflector is mounted to the housing for pivoting movement between three positions of the deflector relative to the housing. In the first position the deflector extends straight from the housing and a stream of water discharged from the housing will pass through the deflector without being deflected. In the second position the deflector is pivoted downwardly relative to the housing and the stream of water discharged from the housing impacts against the deflector and is deflected downwardly in a fanned out spray pattern. In the third position the deflector is pivoted upwardly relative to the housing and the stream of water discharged from the housing impacts with the deflector and is directed upwardly in a fanned out spray pattern.

The twelve component parts of the sprayer nozzle of the invention described above provide the nozzle with a simplified, reduced cost construction. In addition, they provide the nozzle with several desirable features, i.e., the ability to stop liquid flow through the nozzle, open liquid flow through the nozzle without mixing with the separate product, and open liquid flow through the nozzle while mixing with the separate liquid product. In addition, the concentration of the separate product mixed with the liquid passing through the nozzle can be adjusted. Still further, the discharge from the nozzle can be directed as a stream from the nozzle or can be deflected in a fan pattern downwardly and upwardly. By providing valves that rotate about the center axis of the nozzle housing, the different options available to alter the discharge of liquid from the housing are easily controlled.

BRIEF DESCRIPTION OF THE DRAWING FIGURES

Further features of the present invention are set forth in the following detailed description of the preferred embodiment of the intention and in the drawing figures wherein.

DETAILED DESCRIPTION OF THE PREFERRED EMBODIMENT

Figure 1:
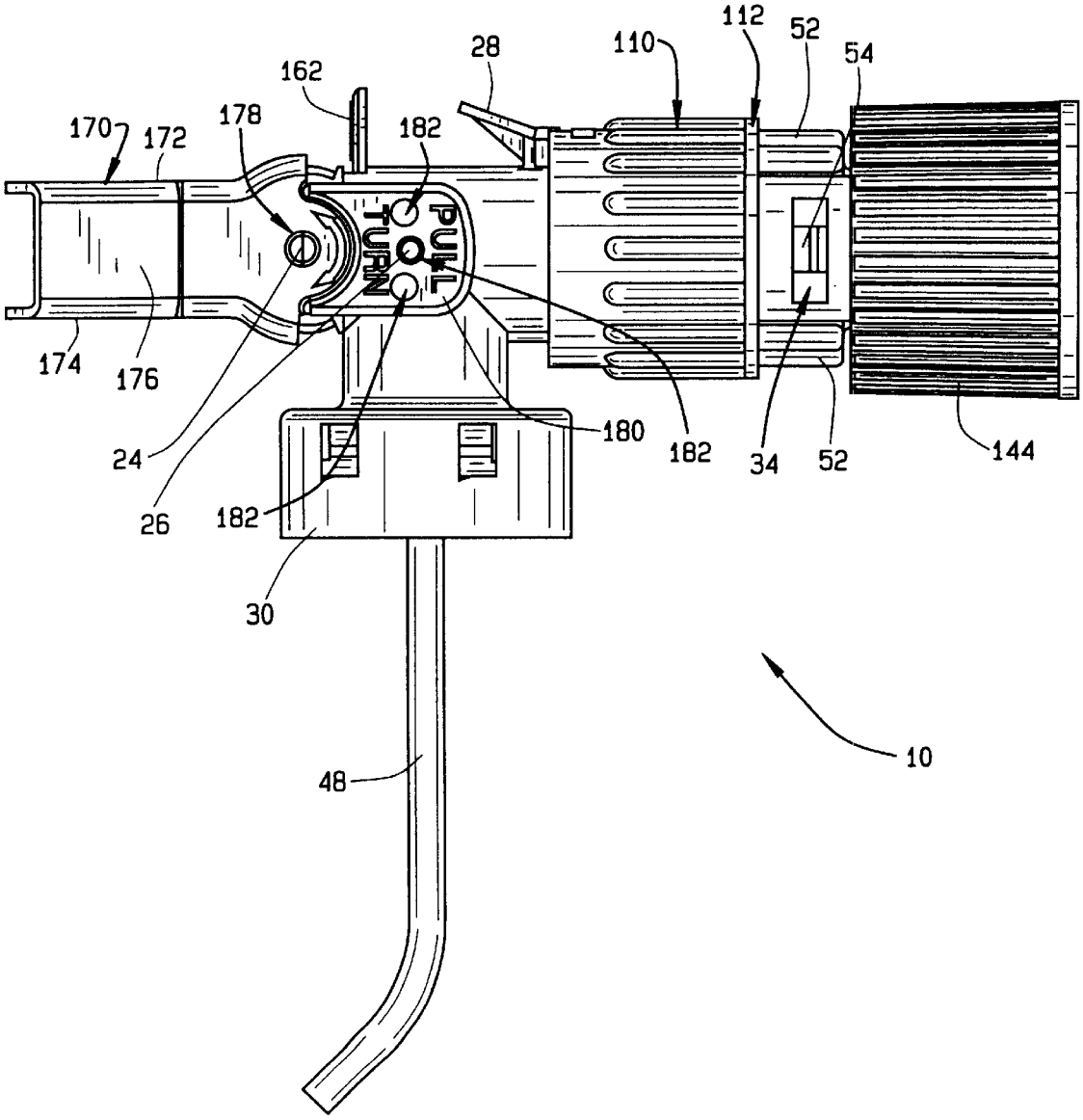
FIG. 1 is a side elevation view of the sprayer nozzle of the invention.

As stated earlier, the adjustable sprayer nozzle (10) of the present invention is assembled from a total of 12 component parts. In the preferred embodiment, the component parts are molded of various types of plastics. The component parts of the adjustable sprayer nozzle include a two piece housing, a three piece fluid flow control valve assembly contained in the housing, a two piece manual actuator mounted on the housing and operatively connected with the control valve assembly, a two piece hose connector mounted on an inlet end of the housing, a dip tube, a product port control valve mounted at an outlet end of the housing and a spray deflector also mounted at the outlet end of the housing. The front of the sprayer nozzle is to the left in FIGS. 1–5 and the rear of the nozzle is to the right.

The two piece housing includes a housing front piece (12) and a housing back piece (14). The front piece (12) and back piece (14) are snap-fit together to define the sprayer housing. The sprayer housing has an interior bore (16) with a center axis (18) that extend through the housing from an inlet end (18) of the housing to an outlet end (22) of the housing. The interior bore (16) of the housing also defines the flow path of liquid supplied to the adjustable sprayer nozzle (20) and channeled through the nozzle housing as will be explained.

The housing front piece (12) has a hollow interior that defines a portion of the housing interior bore (16). The front piece (12) of the housing has a pair of pivot pins (24) projecting from opposite sides of the housing exterior surface. The pivot pins (24) are employed in mounting the spray deflector on the housing as will be explained. A detent pin (26) also projects from the housing exterior surface. The detent pin (26) is also employed in positioning the spray deflector as will be explained. An actuator lock (28) is provided on the top of the housing exterior surface. The actuator lock (28) is employed in holding the manual actuator in predetermined positions relative to the housing that are explained later. A bayonet connector (30) is provided on the housing front piece (12) and is employed in connecting the housing to a separate container of a liquid to be dispensed from the sprayer nozzle (10). The housing has a pair of elongated slots (32) on opposite sides of the housing that extend through a portion of the housing front piece (12)

adjacent its rearward end. The slots (32) extend into the housing interior bore (16) and the lengths of the slots are parallel with the bore center axis (18). A pair of rectangular shaped openings (34) are provided in the housing front piece (12) on opposite sides of the housing interior bore (16) and adjacent to the rearward end of the front piece.

Figure 3:
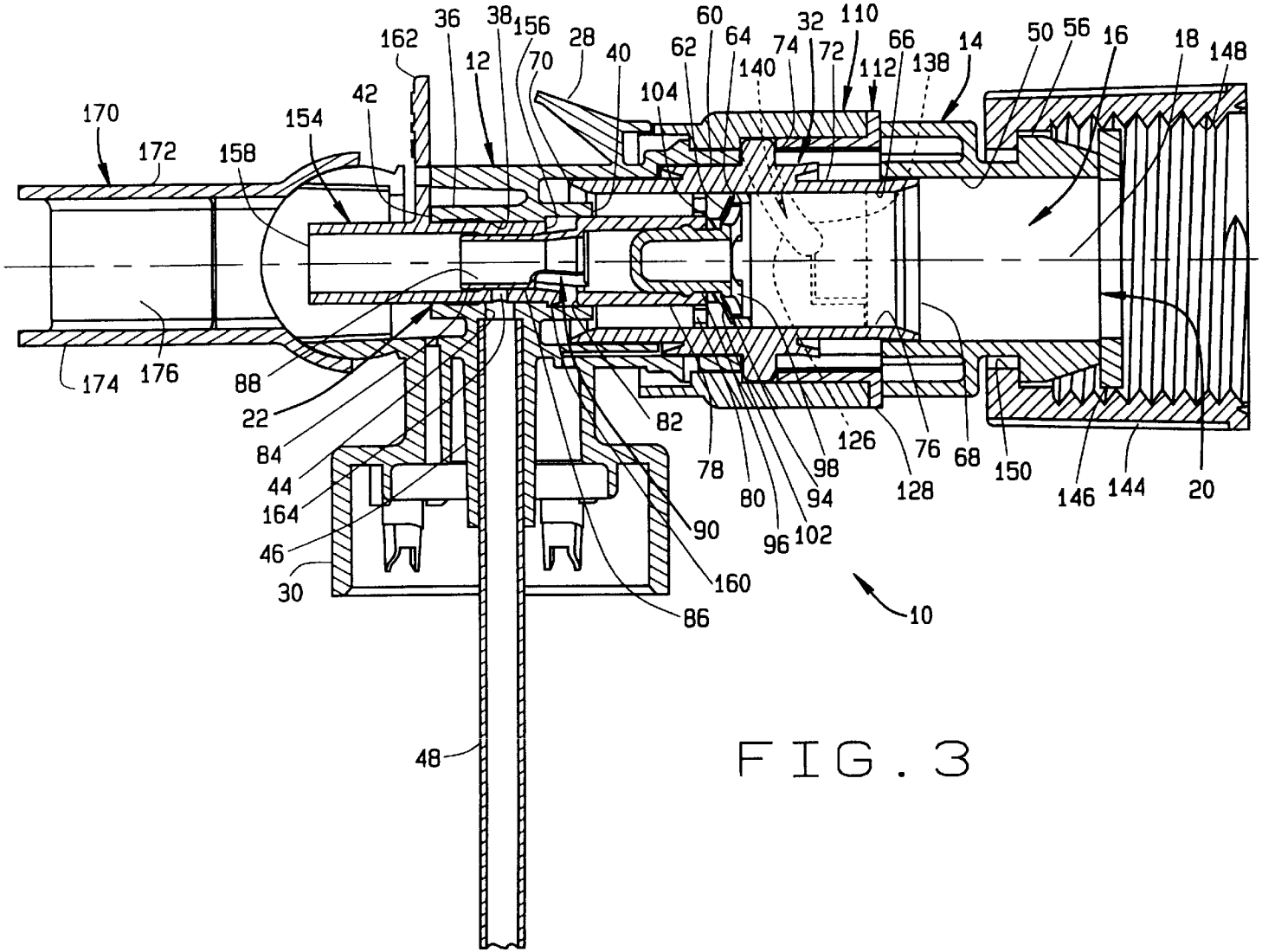
FIG. 3 is a cross-section view of the nozzle shown in FIG. 1, with the nozzle flow path closed.
Figure 4:
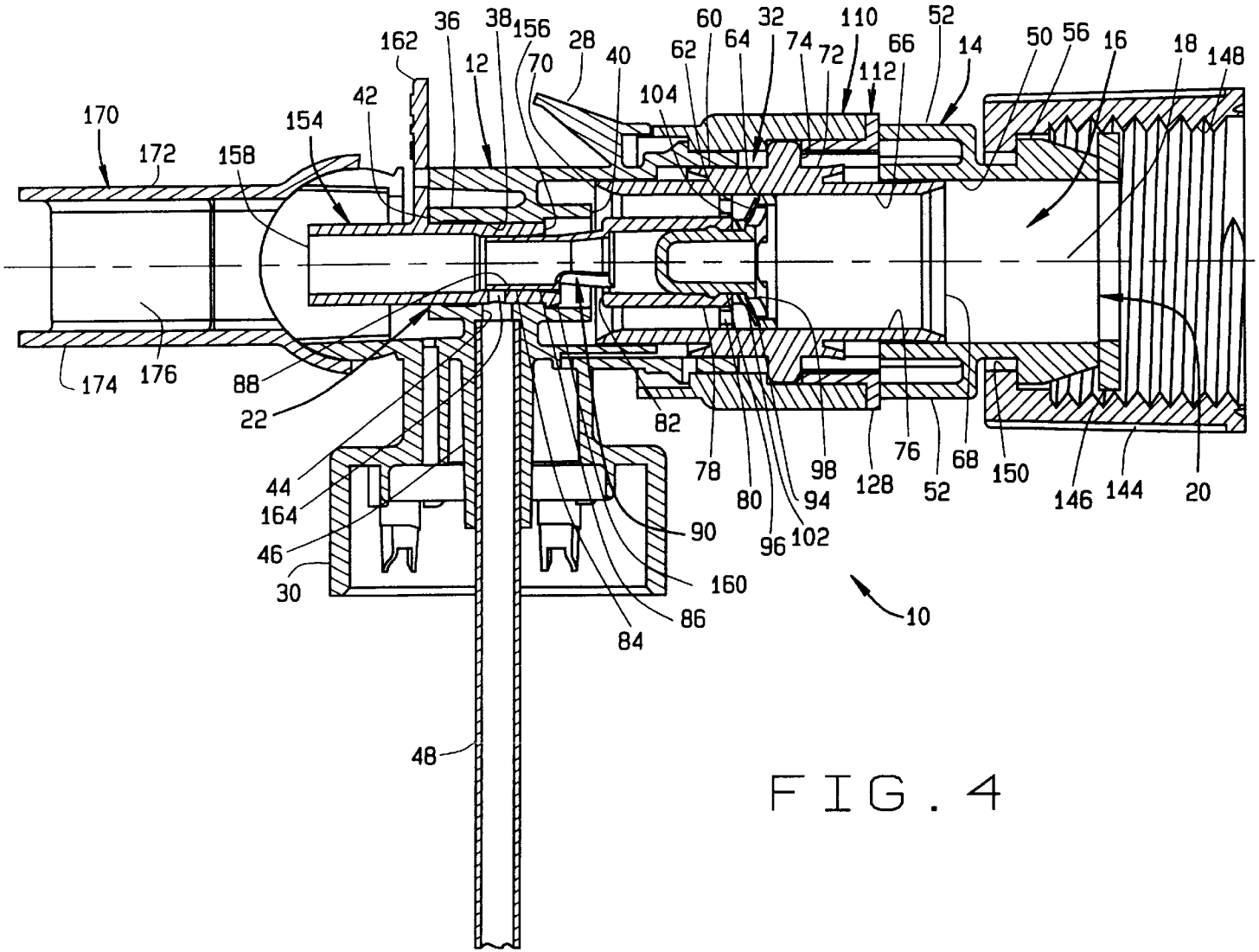
FIG. 4 is a view similar to that of FIG. 3, but with the nozzle flow path opened.
Figure 5:
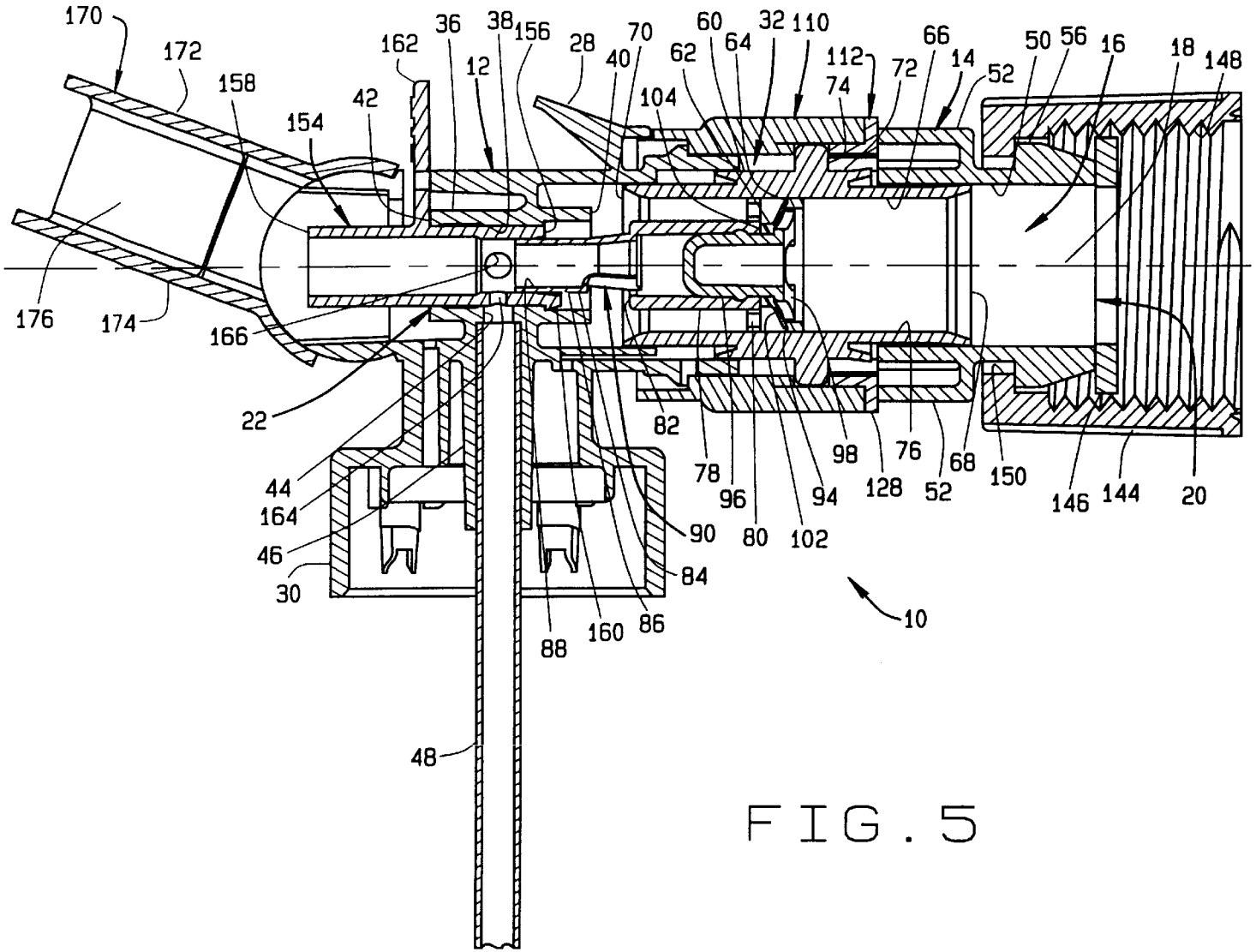
FIG. 5 is a view similar to that of FIG. 4, but with the nozzle flow path opened and in communication with the separate product container.

The housing front piece (12) has a cylindrical interior surface (35) that surrounds the portion of the nozzle interior bore (16) in the housing front piece. The interior surface (35) of the front piece is concentric with the nozzle center axis (18). A cylindrical tube (36) is centered in the housing front piece portion of the interior bore (16). The tube (36) has a cylindrical interior surface (38) that surrounds a center bore of the tube. An upstream end (40) of the tube functions as a circular valve seat, which will be explained later. The opposite downstream end (42) of the tube supports the product port control valve to be described later. A product port (44) extends through the tube intermediate its upstream end (40) and downstream end (42). The product port (44) communicates the interior bore of the tube (36) with the bayonet connector (30) on the exterior of the housing front piece (12). As seen in FIGS. 3 through 5, a hollow column (46) extends from the exterior surface of the housing front piece (12) and surrounds the product port (44). The dip tube (46) is inserted into the hollow column (46) and communicates the product port (44) with the interior of a separate container of product to be dispensed by the sprayer nozzle when the container is attached to the bayonet connector (30).

Figure 2:
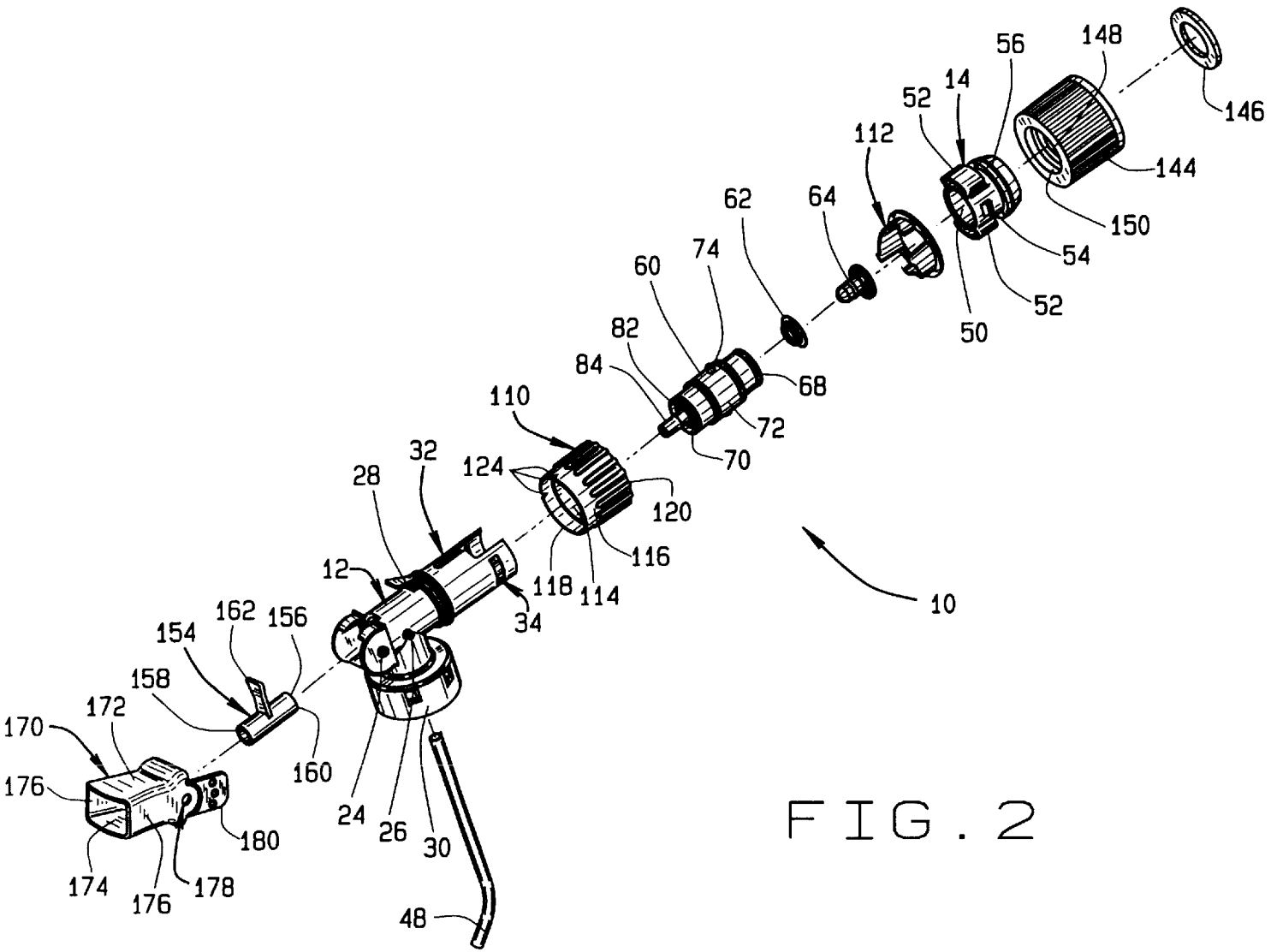
FIG. 2 is an exploded view of the component parts of the nozzle.

The housing back piece (14) has a hollow interior surrounded by a cylindrical interior surface (50) that also defines a portion of the housing interior bore (16). The cylindrical interior surface (50) of the back piece is concentric with the center axis (18). A pair of abutments (52) project from opposite sides of the exterior surface of the housing back piece (14) at the forward end of the back piece. A pair of attachment tabs (54) also project from opposite sides of the exterior surface of the housing back piece (14). As best seen in FIG. 2, the attachment tabs (54) are positioned circumferentially between the housing back piece abutments (52). An annular collar (56) projects from the exterior surface of the housing back piece (14) and extends completely around the housing back piece (14) at its rearward end.

In assembling the housing front piece (12) to the housing back piece (14), the housing back piece (14) is inserted into the interior bore (16) of the housing front piece (12) from the rear of the housing front piece. The housing back piece (14) is inserted into the front piece interior bore until the pair of attachment tabs (54) are aligned with and engage in the pair or rectangular openings (34) at the rearward end of the housing front piece. This snap-fits or snap connects the housing front piece (12) with the housing back piece (14) and defines the interior bore (16) that extends completely through the assembled housing from the inlet end (20) to the outlet end (22). However, before the housing front piece (12) and back piece (14) are assembled together in forming the housing, the control valve assembly is first assembled and positioned in the portion of the housing interior bore in the housing front piece (12) and the manual actuator assembly is assembled over the exterior surface of the housing front piece.

The control valve assembly is comprised of a control valve (60), a back flow valve (62) and a back flow valve seat (64) that are assembled together in constructing the control valve assembly. The control valve (60) is generally cylindrical and has a hollow interior bore (66) that forms a portion of the flow path through the sprayer nozzle (10). The control valve interior bore (66) is concentric with the housing center axis (18) and extends through the control valve from an inlet end (68) to an outlet end (70) of a control valve. As seen in FIGS. 3 through 5, a portion of the control valve exterior surface (72) adjacent the valve outlet end (70) engages in a sliding, sealing engagement with the interior surface (35) of the portion of the housing interior bore (16) in the housing front piece (12) and a portion of the control valve exterior surface (72) adjacent the valve inlet end (68) engages in a sliding, sealing engagement with the interior surface (50) of the portion of the interior bore (16) in the housing back piece (14). A pair of cam follower posts (74) project from the control valve exterior surface (72) on opposite sides of the control valve. When the control valve (60) is assembled to the housing, the posts (74) are inserted into the pair of slots (32) in the housing front piece (12) and permit axial reciprocating movement of the control valve (60) through the interior bore of the housing front piece (12), but prevent rotation of the control valve (60) in the interior bore.

The control valve interior surface (76) surrounds the control valve interior bore (66). A tubular valve support (78) is held in a centered position in the control valve interior bore (66) by a plurality of circumferentially spaced spokes or arms (80) that extend between the tubular valve support (78) and the interior surface (76) of the control valve. The fluid flow path through the interior bore of the sprayer housing passes through the spacings between the plurality of spokes (80). The tubular valve support (78) extends in a downstream direction or along the flow path through the housing to a circular valve element (82) at the forward end of the tubular support. The circular valve element (82) is dimensioned to seat inside the circular valve seat at the upstream or rearward end (40) of the cylindrical tube (36) in the housing front piece (12), as will later be explained. A second valve element in the form of a cylindrical sleeve valve (84) projects further downstream from the first, circular valve element (82). The sleeve valve (84) has a cylindrical exterior surface (86) and a hollow interior bore (88) that forms a portion of the flow path through the sprayer housing. An opening (90) is provided through the sleeve valve (84) adjacent its connection to the first valve element (82). The opening (90) communicates the fluid flow path passing through the control valve interior bore (66) and the spacings between the valve support arms (80) with the sleeve valve interior bore (88). Thus, the sleeve valve interior bore (88) forms a portion of the fluid flow path through the sprayer nozzle.

The back flow valve seat (64) has a circular outer perimeter ring (94) and a cylindrical center hub (96) that are connected together by a plurality of arms (98). The plurality of arms (98) extend radially between the center hub (96) and the outer ring (94) and are spatially arranged around the center hub (96) leaving spacings between adjacent arms (98). The fluid flow path of the nozzle passes through the spacings between the adjacent arms (98).

The back flow valve (62) is a flexible disc valve having an annular flange portion (102) and a circular collar (104) at the center of the flange portion. The valve circular collar (104) is assembled over the center hub (96) of the back flow valve seat (64) with the annular flange portion (102) of the valve covering over the arms (98) and the spacings between the arms of the valve seat (64). The outer perimeter of the valve flange portion (102) lays against the perimeter ring (94) of the valve seat (64). The valve seat (64) is assembled to the control valve (60) by inserting the valve seat hub (96) in the hollow interior of the tubular valve support (78) of a control valve. This positions the outer perimeter ring (94) of the back flow valve seat (64) against the interior surface (76) of the control valve. Thus, the fluid flow path through the control valve interior bore (66) passes through the spacings between the back flow valve seat arms (98) displacing the back flow valve annular flange (102) from the arms and the seat outer perimeter ring (94), and then continues through the control valve interior bore (66) to the outlet end (70) of a control valve. A reverse flow of liquid through the control valve interior bore (66) from the valve outlet end (70) to the valve inlet end (68) is prevented by the back flow valve flange (102) laying over the back flow valve seat arms (98) and perimeter ring (96) and the spacings between the arms.

The two piece manual actuator is comprised of an actuator front piece (110) and an actuator back piece (112). The actuator front piece (110) has a cylindrical interior surface (114) and a cylindrical exterior surface (116) and axially opposite forward (118) and rearward (120) edges. The exterior surface (116) has a plurality of axially extending raised ribs (122) that assist in manually gripping the actuator. A plurality of notches, specifically three notches (124) are provided in the forward edge (118) of the actuator front piece. The front piece interior surface (114) has a pair of cam surfaces (126) that spiral or extend axially as they extend circumferentially around portions of the interior surface (114) of the actuator front piece.

The manual actuator back piece (112) is generally cylindrical and has an annular flange (128) at the rearward edge of the back piece and a pair of arcuate panels (130) that project axially from the annular flange. The arcuate panels (130) have cylindrical interior surface portions (132) and cylindrical exterior surface portions (134) that give the actuator back piece (112) its general cylindrical configuration. The panels (130) extend axially from the annular flange (128) to forward edges (136) of the arcuate panels. A pair of cam surfaces (138) are formed in the forward edges (136). The pair of cam surfaces (138) of the actuator back piece (112) are complementary to the pair of cam surfaces (126) in the interior of the manual actuator front piece (110). Together, the two pairs of cam surfaces (126, 138) form a cam slot that spirals around the interior of the manual actuator front piece (110). One of the cam slots (140) is shown in dashed lines in FIG. 3.

In assembling the control valve assembly and the manual actuator to the sprayer nozzle housing, the actuator front piece (110) is first assembled over the rearward end of the housing front piece (12). The control valve assembly, with the back flow valve seat (64) and back flow valve (62) assembled into the interior of the control valve (66), is then inserted into the portion of the interior bore (16) in the housing front piece (12) with the control valve posts (74) in sliding engagement with the pair of slots (32) in the housing front piece. The manual actuator back piece (112) is then assembled into the actuator front piece (110) with the posts (74) of the control valve (60) positioned in the spiraling slots (140) formed by the actuator front piece cam surfaces (126) and the actuator back piece cam surfaces (138). The housing back piece (14) is then assembled into the housing front piece (12) with the attachment tabs (54) on the housing back piece snapping into engagement in the rectangular openings (34) of the housing front piece. This positions the abutments (52) on the housing back piece against the annular flange (128) of the manual actuator back piece, preventing the manual actuator from sliding off of the exterior surface of the assembled housing.

The two piece hose connector is comprised of a cylindrical cap (144) and a circular washer or gasket (146). The cylindrical cap (144) has an interior bore with internal screw threading (148) extending along a portion of the cap internal bore. The screw threading (148) is complementary to the conventional external screw threading of a garden hose. An annular shoulder (150) is also provided in the cap interior bore at one axial end of the cap. The shoulder (150) is dimensioned slightly larger than the annular collar (56) on the housing back piece (14) enabling the shoulder (150) to be snapped over the collar (56) to attach the cap for rotation on the housing inlet end (20). The washer (146) is inserted into the cap interior bore and seats against the housing inlet end (20).

The product port control valve (154) is a cylindrical valve having a center bore that extends between axially opposite input (156) and output (158) ends of the cylinder valve. The input end (156) of the valve has a tab (160) that projects radially outwardly from the input end. As seen in FIGS. 3 through 5, the input end tab (160) engages over the housing tube upstream end (40) and prevents axial movement of the product port control valve (154) in the tube while permitting rotational movement of the valve in the tube. A lever (162) projects from the exterior of the valve and is in sliding engagement with the opposite downstream end (42) of the housing tube. This positioning of the lever also prevents axial movement of the product port control valve while allowing rotational movement. The product port control valve (154) has a first valve opening (164) and second valve opening (166) that pass through the valve and communicate with the valve interior bore. In the preferred embodiment of the invention the first valve opening (164) is spaced 90 degrees from the second valve opening (166), and the second valve opening is larger or has a greater opening area than the first valve opening.

The spray deflector (170) is tubular and has a rectangular cross section defined by opposite top (172) and bottom (174) walls of the deflector and opposite side walls (176) of the deflector. The side walls (176) have coaxial pivot pin holes (178) that receive the pivot pins (24) on the housing front piece (12) in mounting the deflector to the housing. A tab (180) projects from one of the deflector side walls (176). The tab (180) has three detent holes (182) that are positioned on the tab (80) where they will align with the detent pin (26) on the side of the housing front piece (12) as the spray deflector (170) is pivoted about its connection to the pivot pins (24) of the housing front piece.

In operation of the adjustable sprayer nozzle (10), a garden hose is connected to the cap (144) at the inlet end (20) of the sprayer housing to supply a source of water to the nozzle. A separate container (not shown) of a product to be selectively mixed with and discharged with the flow of water directed through the nozzle is connected to the bayonet connector (30) of the housing. With the supply of water and the separate product connected to the sprayer nozzle (10), the manual actuator comprised of the two actuator pieces (110, 112) can be selectively, manually rotated about the sprayer to vary the discharge from the sprayer.

Manual rotation of the manual actuator (110, 112) in different directions around the sprayer housing moves the control valve (60) between three positions relative to the housing interior bore (16) and the liquid flow path through the housing interior bore. FIG. 3 shows the first position of the control valve (60) relative to the housing. In FIG. 3 the actuator lock (28) on the housing is engaged in one of the three notches (124) in the forward end of the actuator. In FIG. 3 the actuator lock (28) is positioned in the "off" notch of the manual actuator front piece (110). The control valve (60) is positioned in the housing interior bore with the first, circular valve element (82) engaged in the valve seat at the upstream end (40) of the tube (36) contained in the housing front piece (12), and with the second, sleeve valve element (84) covering over the aligned product port (44) and first valve opening (154) of the product port control valve. Thus, in the first position of the control valve (60) the fluid flow path through the sprayer nozzle is closed and communication of the dip tube (48) and product port (44) with the housing interior bore is closed.

FIG. 4 shows the two piece manual actuator (110, 112) rotated relative to the housing causing the control valve (60) to move to its second position in the housing interior bore. To rotate the manual actuator, the actuator lock (28) is bent away from its engagement in one of the notches (124) of the actuator, allowing the actuator to be rotated. In FIG. 4 the actuator lock (28) is engaged in the second notch identified as the "water" notch on the exterior of the actuator. The movement of the actuator to the position shown in FIG. 4 rotates the cam slots (140) defined by the cam surfaces (126, 138) around the sprayer housing. The engagement of the control valve posts (74) in the cam slots pushes the control valve axially through housing interior bore toward the inlet end (20) of the housing. In the position of the control valve (60) relative to the housing shown in FIG. 4, the first valve element (82) has been disengaged from the valve seat at the upstream end (40) of the tube contained in the first housing piece (12). This allows the fluid flow path to flow through the interior bore (16) of the housing and the interior bore (66) of the control valve to the opening (90) in the side of the second, sleeve valve element (84). The flow of fluid continues through the interior of the second, sleeve valve element (84) and the interior of the tube (36) contained in the housing front piece (12) to the spray deflector (170) where the flow of fluid is discharged from the sprayer nozzle. However, the second, sleeve valve element (84) remains over the valve opening (164) of the product port control valve (154) preventing communication of the product port (44) with the flow path through the sprayer housing. Thus, only water is discharged from the sprayer housing with the control valve positioned as shown in FIG. 4.

FIG. 5 shows the two piece manual actuator (110, 112) rotated to its third position which causes the control valve (60) to move to its third position relative to the sprayer housing. Again the actuator lock (28) is disengaged from the "water" notch (124) in the actuator front piece (110) and the actuator is rotated until the lock engages in the "product" notch. This movement of the actuator causes the control valve (60) to move axially through the interior bore (16) of the sprayer and moves the second sleeve valve element (84) from its position covering over the first valve opening (164) of the product port control valve (154). This communicates the product port (44) with the flow path of water through the housing interior. The flow of water over the first valve opening (164) and the product port (44) creates a venturi effect that draws product contained in a separate container attached to the bayonet connector (30) up through the dip tube (48), the product port (44) and the first valve opening (164), mixing the product with the flow of water passing through the sprayer nozzle. Thus, in FIG. 5, a mixture of water and product is dispensed from the sprayer nozzle.

The concentration of the product mixed with the water flowing through the sprayer nozzle can be adjusted by adjustably positioning the product port control valve (154) between its two positions relative to the sprayer housing. In FIG. 5 the product port control valve (154) is positioned so that its first valve opening (164) is aligned with the product port (44). The first valve opening (164) has a smaller opening area than the second valve opening (166), and therefore a smaller concentration of the product will be mixed with the water flowing along the sprayer nozzle flow path. Rotating the product port control valve (154) so that the second valve opening (166) is aligned with the product port (44) will increase the concentration of product mixed with the water flowing along the fluid flow path through the sprayer nozzle.

Figure 6:
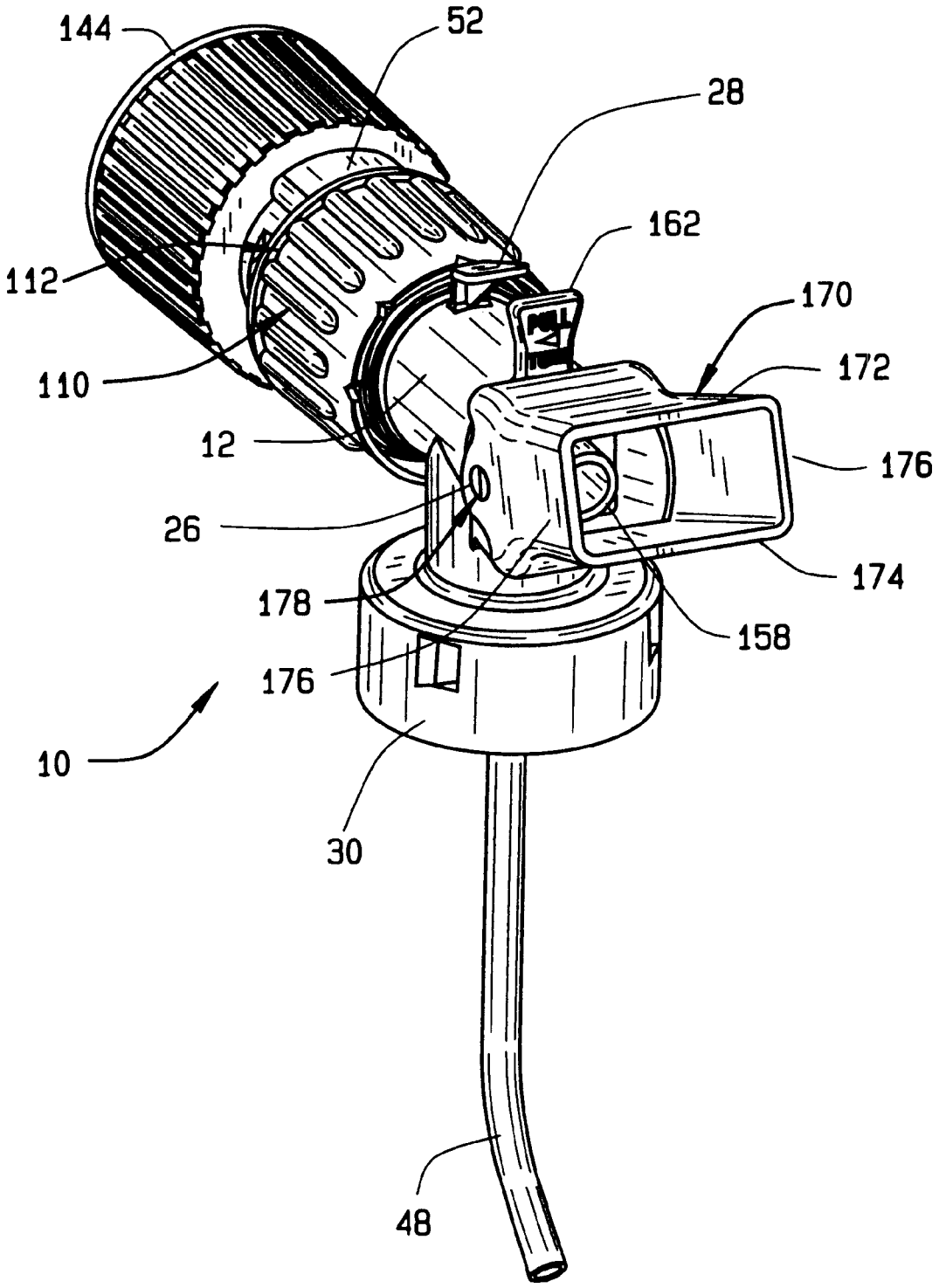
FIG. 6 is a perspective view of the nozzle with its deflector positioned upwardly.

FIG. 3 shows the first position of the sprayer deflector (170) relative to the sprayer housing. In the first position of the spray deflector (170) the liquid discharged from the downstream end (42) of the tube (36) of the housing front piece (12) is discharged as a stream that passes through the deflector (170) without impacting with the top wall (172), the bottom wall (174) or the side walls (176) of the deflector. FIGS. 5 and 6 show the deflector (170) moved to its upwardly pivoted position. The deflector is moved by manually bending the deflector tab (180) outwardly from the housing front piece (12) disengaging the center tab detent hole (182) from the detent pin (26) on the side of the housing front piece. This enables the tab to be pivoted about the pair of pivot pins (24) on the housing front piece to the position shown in FIG. 5 where the detent pin (26) aligns with the upper tab detent hole (182). Engagement of the detent pin (26) in the upper detent hole (182) of the tab holds the deflector (170) in its upward orientation shown in FIGS. 5 and 6. A stream of liquid discharged from the downstream end (42) of the housing front piece tube (36) will impact against the spray deflector bottom wall (174) and will be discharged in an upwardly directed fanned out spray pattern.

Figure 7:
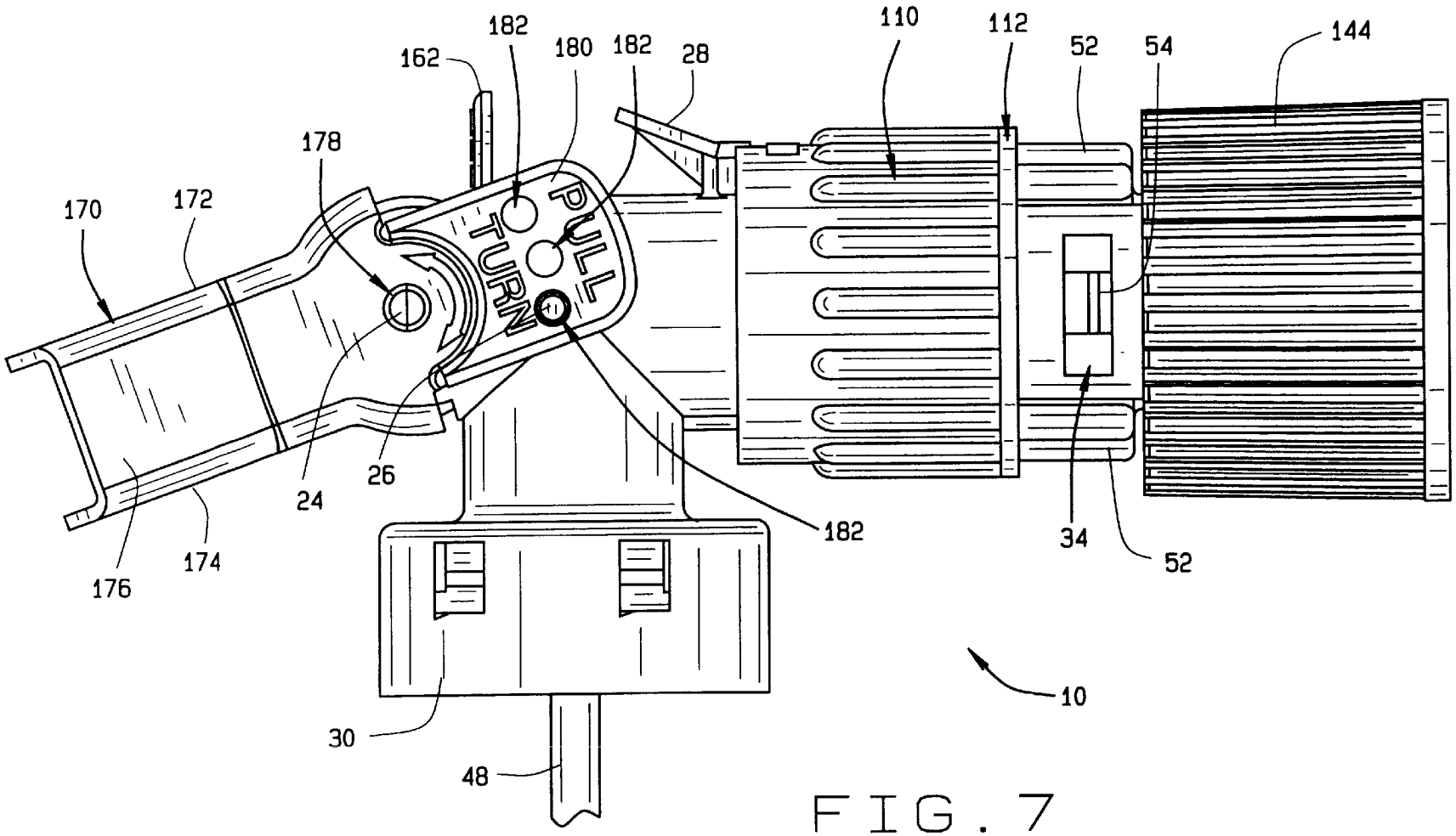
FIG. 7 is a side elevation view of the nozzle with its deflector positioned downwardly.
Figure 9:
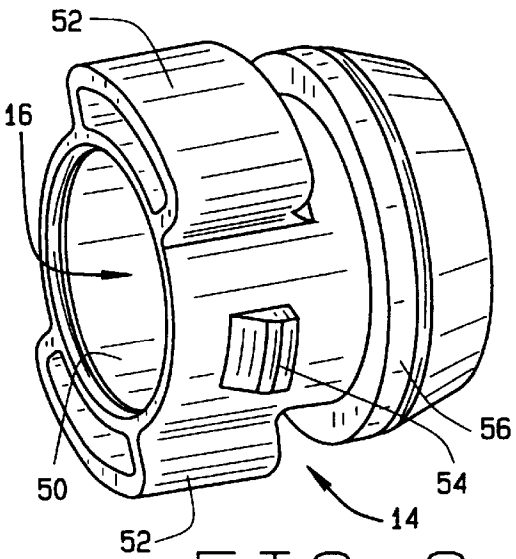
FIG. 9 is an enlarged view of the housing back piece.
Figure 10:
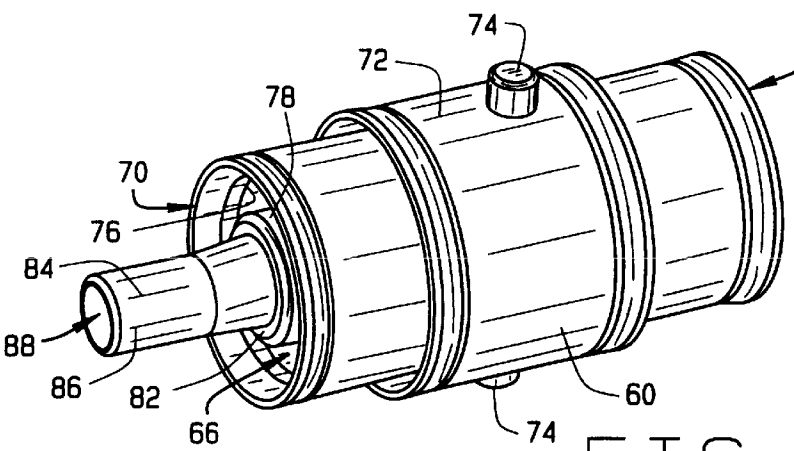
FIG. 10 is an enlarged view of the control valve.
Figure 8:
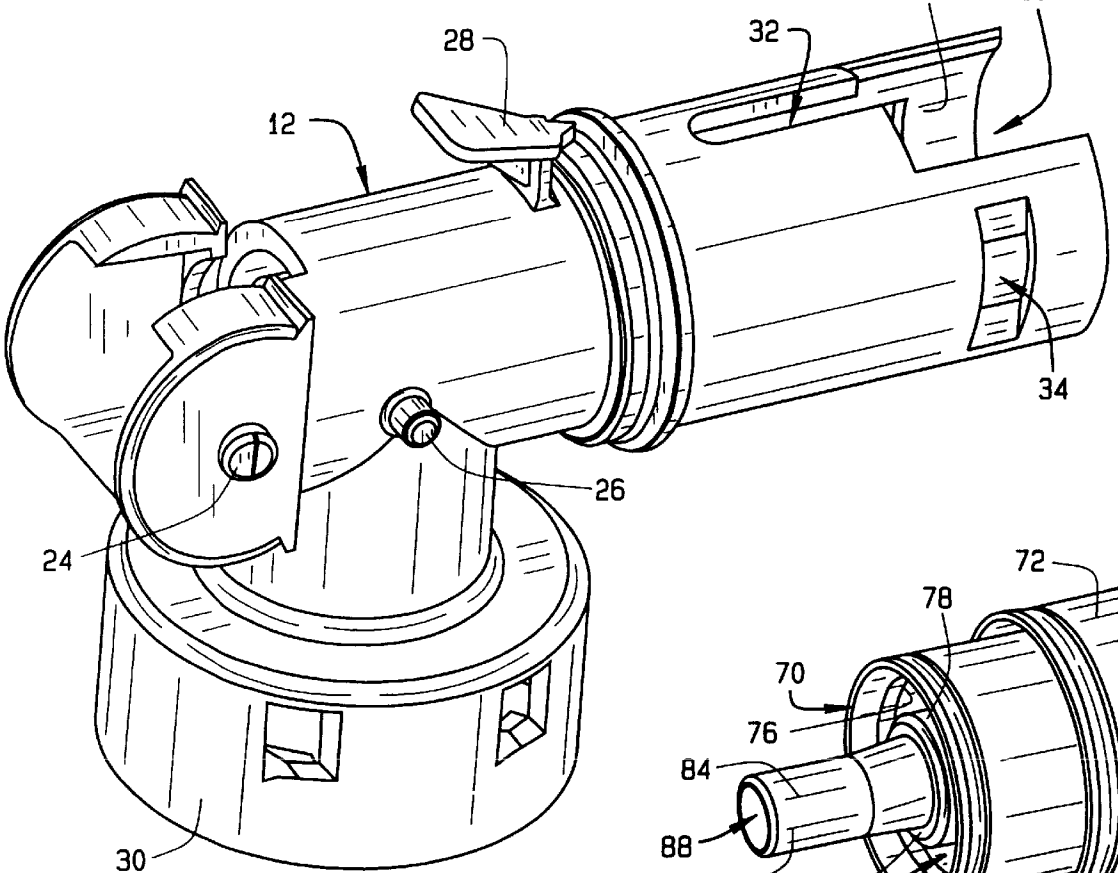
FIG. 8 is an enlarged view of the housing front piece.
Figure 11:
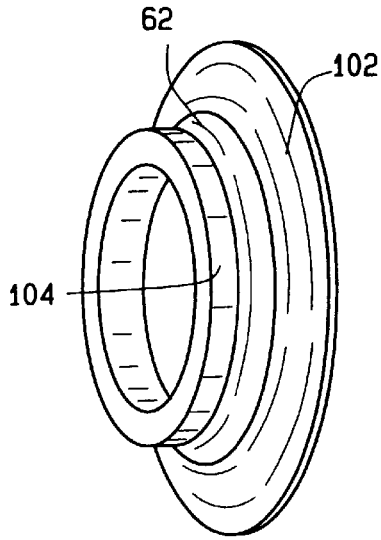
FIG. 11 is an enlarged view of the backflow valve.
Figure 12:
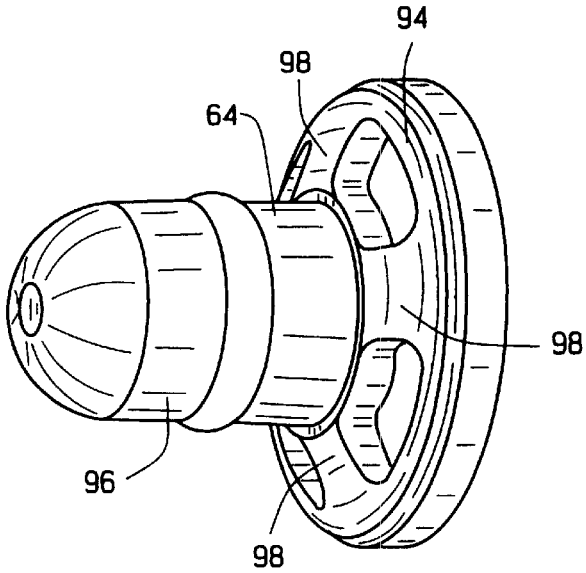
FIG. 12 is an enlarged view of the backflow valve seat.
Figure 13:
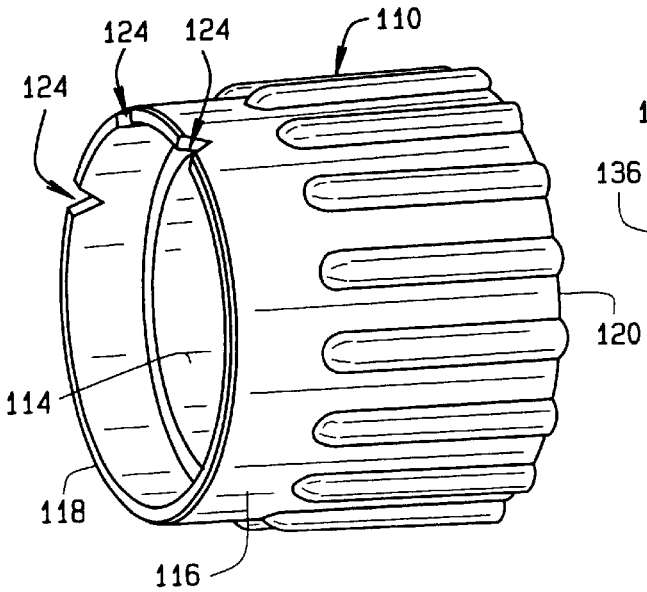
FIG. 13 is an enlarged view of the manual actuator front piece.
Figure 14:
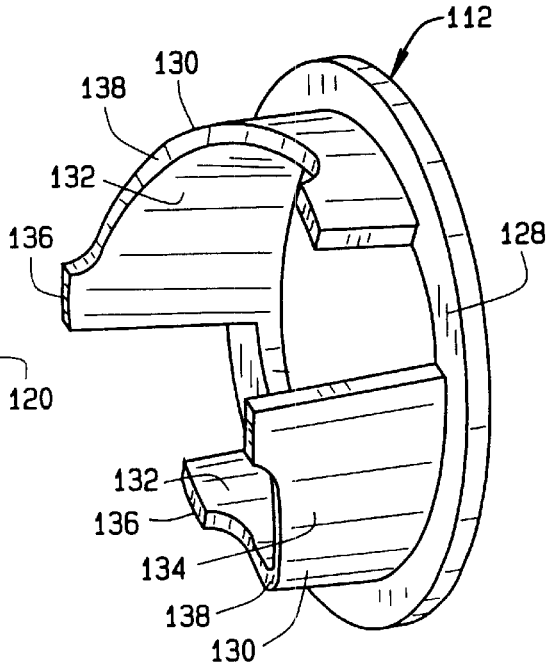
FIG. 14 is an enlarged view of the manual actuator back piece.

In a like manner, the deflector (170) can be directed downwardly as shown in FIG. 7. Again, the tab (180) is pulled outwardly from the detent pin (26) on the side of the housing front piece (12) enabling the pivoting movement of the deflector. The deflector is pivoted downwardly until the detent pin (26) on the housing front piece (12) is aligned with the bottom tab detent hole (182). Releasing the tab (180) and engaging the detent pin (26) in the bottom detent hole (182) holds the deflector (170) in its downwardly oriented position shown in FIG. 7. A stream of liquid discharge from the downstream end (42) of the tube (36) in the housing front piece (12) will impact against the deflector top wall (132) and will be discharged in a downwardly directed fanned out spray pattern.

The twelve component parts of the sprayer nozzle of the invention described above provide the nozzle with a simplified, reduced cost construction. In addition, they provide the nozzle with several desirable features, i.e., the ability to stop liquid flow through the nozzle, to open liquid flow through the nozzle without mixing with the separate product, and to open liquid flow through the nozzle while mixing with the separate liquid product. In addition, the concentration of the separate product mixed with the liquid passing through the nozzle can be adjusted. Still further, the liquid discharge from the nozzle can be directed as a stream from the nozzle or can be deflected in a fan pattern downwardly and upwardly. By providing valves that are operated by manual rotation of valve actuators about the center axis of the nozzle housing, the different options available to alter the discharge of liquid from the nozzle are easily controlled.

While the present invention has been described by reference to a specific embodiment, it should be understood that modifications and variations of the invention may be constructed without departing from the scope of the invention defined in the following claims:

1. An adjustable nozzle comprising:

a housing having an inlet end and an opposite outlet end and an interior with a fluid flow path extending through the housing interior from the inlet end to the outlet end;

a first connector on the housing that is connectable to a separate source of water to be dispensed by the nozzle;

a second connector on the housing that is connectable to a separate source of product to be dispensed by the nozzle; and, a control valve mounted in the housing interior for movement along the fluid flow path between a first position of the control valve relative to the housing where the control valve blocks the flow path between the housing inlet end and the housing outlet end, a second position of the control valve relative to the housing where the control valve opens the flow path between the housing inlet end and the housing outlet end, and a third position of the control valve relative to the housing where the control valve opens the flow path between the housing inlet end and the housing outlet end and communicates the flow path with the second connector and with a separate source of product when a separate source of product is connected to the second connector.

2. The nozzle of claim 1, further comprising:

a manual actuator mounted on the housing for rotation of the actuator in opposite first and second directions about the housing and the flow path, the manual actuator being operatively connected with the control valve to cause the control valve to move in opposite first and second directions along the flow path in response to the manual actuator being rotated in the opposite first and second directions respectively.

3. The nozzle of claim 2, further comprising:

one of the control valve and manual actuator having a spiraling cam surface and the others of the control valve and manual actuator having a cam follower in sliding engagement with the cam surface.

4. The nozzle of claim 1, further comprising:

the housing having a circular valve seat with the fluid flow path passing through the valve seat and the control valve having a circular first valve element that seats against the valve seat when the control valve is in the first position.

5. The nozzle of claim 4, further comprising:

the housing having a product port along the flow path that communicates the separate source of product with the flow path when the separate source of product is connected to the second connector and the control valve is in the third position, the control valve having a second valve element that closes the product port when the control valve is in the first and second positions.

6. The nozzle of claim 5, further comprising:

the second valve element being a cylindrical sleeve valve with an interior bore through the sleeve valve and the fluid flow path passing through the sleeve valve interior bore.

7. The nozzle of claim 6, further comprising:

the housing having a center axis that extends along the flow path and the circular first valve element and the cylindrical sleeve valve are concentric with the housing center axis.

8. The nozzle of claim 5, further comprising:

a product port valve mounted on the housing for movement between first and second positions of the product port valve relative to the housing where in the first position of the product port valve a first area of the product port communicates with the flow path and in the second position of the product port valve a second area of the product port communicates with the flow path and the second area is larger than the first area.

9. The nozzle of claim 8, further comprising:

the product port valve is mounted on the housing for rotation of the product port valve in opposite directions between the first and second positions of the product port valve.

10. The nozzle of claim 8, further comprising:

the product port valve being a cylinder valve with a center bore extending through the cylinder valve and a valve opening passing through the cylinder valve to the cylinder center bore, and the fluid flow path passing through the cylinder valve center bore.

11. The nozzle of claim 1, further comprising:

the control valve having a center bore through the control valve and the fluid flow path extends through the control valve center bore.

12. The nozzle of claim 11, further comprising:

a back flow valve positioned in the control valve center bore, the back flow valve being operable to permit fluid flow along the flow path from the housing inlet end to the housing outlet end and to prevent fluid flow along the flow path from the housing outlet end to the housing inlet end.

13. The nozzle of claim 1, further comprising:

a fluid flow deflector mounted to the housing outlet end for pivoting movement of the deflector between a first position of the deflector relative to the housing where the deflector does not deflect a flow of fluid that passes through the housing flow path and emerges from the housing outlet end, a second position of the deflector relative to the housing where the deflector upwardly deflects a flow of fluid that passes through the housing flow path and emerges from the housing outlet end, and a third position of the deflector relative to the housing where the deflector downwardly deflects a flow of fluid that passes through the housing flow path and emerges from the housing outlet end.

14. The nozzle of claim 1, further comprising:

the first connector having means for connecting the first connector to a garden hose.

15. An adjustable nozzle comprising:

a housing having an inlet end and an opposite outlet end and an interior with a fluid flow path extending through the housing interior from the inlet end to the outlet end;

a control valve mounted in the housing interior for movement along the fluid flow path between a first position of the control valve relative to the housing where the control valve blocks the flow path between the housing inlet end and the housing outlet end and a second position of the control valve relative to the housing where the control valve opens the flow path between the housing inlet end and the housing outlet end; and a manual actuator mounted on the housing for rotation of the actuator in opposite first and second directions around the housing and around the fluid flow path, the manual actuator being operatively connected with the control valve to cause the control valve to move in opposite first and second directions along the flow path in response to the manual actuator being rotated in the opposite first and second directions respectively.

16. The nozzle of claim 15, further comprising:

the housing having a center axis that extends along the flow path and the control valve moves axially along the center axis between the first and second positions of the control valve and the manual actuator rotates in the opposite first and second directions around the center axis.

17. The nozzle of claim 16, further comprising:

one of the control valve and manual actuator having a cam surface that extends around the center axis and the other of the control valve and manual actuator having a cam follower in sliding engagement with the cam surface.

18. The nozzle of claim 17, further comprising:

the cam surface surrounding a slot that extends around the center axis.

19. The nozzle of claim 16, further comprising:

the housing having a circular valve seat concentric with the center axis, the fluid flow path passing through the circular valve seat and the control valve having a circular valve element concentric with the center axis that seats against the valve seat when the control valve is in the first position.

20. The nozzle of claim 16, further comprising:

the control valve having a center bore through the control valve that is concentric with the center axis and the fluid flow path extends through the control valve center bore.

21. The nozzle of claim 20, further comprising:

a back flow valve positioned in the control valve center bore concentric with the center axis, the back flow valve being operable to permit fluid flow along the flow path from the housing inlet end to the housing outlet end and to prevent fluid flow along the flow path from the housing outlet end to the housing inlet end.

22. The nozzle of claim 16, further comprising:

a hose connector on the housing inlet end, the hose connector having an interior bore that is connectable to a separate hose and is concentric with the center axis.

23. The nozzle of claim 15, further comprising:

a fluid flow deflector mounted to the housing outlet end for pivoting movement of the deflector between a first position of the deflector relative to the housing where the deflector does not deflect a flow of fluid that passes through the housing flow path and emerges from the housing outlet end, a second position of the deflector relative to the housing where the deflector upwardly deflects a flow of fluid that passes through the housing flow path and emerges from the housing outlet end, and a third position of the deflector relative to the housing where the deflector downwardly deflects a flow of fluid that passes through the housing flow path and emerges from the housing outlet end.

24. The nozzle of claim 16, further comprising:

a container connector on the housing that is connectable to a container of product to be dispensed by the nozzle;

a product port in the housing that communicates the fluid flow path with the container connector; and, the control valve being mounted in the housing interior for movement of the control valve along the fluid flow path between the first position where the control valve closes the product port, the second position where the control valve closes the product port, and a third position of the control valve relative to the housing where the control valve opens the product port and opens the flow path between the housing inlet end and the housing outlet end communicating the flow path with the product port.

25. The nozzle of claim 24, further comprising:

the control valve having a cylindrical sleeve valve with an interior bore that is concentric with the center axis, the fluid flow path passes through the sleeve valve interior bore and the sleeve valve closes the product port when the control valve is in the first and second positions.

26. The nozzle of claim 24, further comprising:

a product port valve mounted on the housing for movement between a first position of the product port valve relative to the housing where the product port valve opens communication between a first area of the product port and the fluid flow path and a second position of the product port valve relative to the housing where the product port valve opens communication between a second area of the product port and the fluid flow path, the second area being larger than the first area.

27. The nozzle of claim 26, further comprising:

the product port valve is mounted on the housing for rotation of the product port valve in opposite directions around the center axis between the first and second positions of the product port valve.

28. The nozzle of claim 26, further comprising:

the product port valve being a cylinder valve with a center bore that is coaxial with the housing center axis, the cylinder valve having first and second valve openings passing through the cylinder valve to the cylinder valve center bore, the first valve opening aligning with the product port in the first position of the product port valve and the second valve opening aligning with the product port in the second position of the product port valve, the second valve opening being larger than the first valve opening.

29. An adjustable nozzle comprising:

a housing having an inlet end and an opposite outlet end, an interior with a fluid flow path extending through the housing interior from the inlet end to the outlet end and the housing having a product port communicating with the fluid flow path;

a first connector on the housing that is connectable to a separate source of water to be dispensed by the nozzle;

a second connector on the housing at the product port that is connectable to a separate source of product to be dispensed by the nozzle;

a control valve mounted in the housing interior for movement relative to the fluid flow path between one position of the control valve where the control valve blocks the flow path between the housing inlet end and the housing outlet end and closes the product port and another position of the control valve where the control valve opens the flow path between the housing inlet end and the housing outlet end and opens the product port communicating the flow path with a separate source of product connected to the second connector; and, a product port valve mounted on the housing for movement relative to the housing and the fluid flow path between a first position of the product port valve where the product port valve opens a first valve opening area between the flow path and the product port communicating the product port with the flow path through the first valve opening area and a second position of the product port valve where the product port valve opens a second valve opening area between the flow path and the product port communicating the product port with the flow path through the second valve opening area, where the second valve opening area is larger than the first valve opening area.

30. The nozzle of claim 29, further comprising:

the product port valve having a first valve opening with the first valve opening area and a second valve opening with the second valve opening area, and the first valve opening is moved into alignment with the product port and the second valve opening is moved into alignment with the product port in response to the product port valve being moved to the respective first and second positions of the product port valve relative to the flow path.

31. The nozzle of claim 30, further comprising:

the product port valve being a cylinder valve with a center bore with a center axis and the first valve opening and the second valve opening passing through the cylinder valve to the center bore, and the product port valve being mounted on the housing for rotational movement of the product port valve about the center axis between the first and second positions of the product port valve relative to the housing and the flow path.

32. The nozzle of claim 29, further comprising:

the control valve being mounted in the housing interior for movement along the fluid flow path to a further position of the control valve relative to the fluid flow path where the control valve blocks the product port and does not block the fluid flow path.

33. The nozzle of claim 31, further comprising:

the fluid flow path having a center axis that is coaxial with the product port valve center axis.

* * * * *